US008327936B2

(12) United States Patent
Coskuner

(10) Patent No.: US 8,327,936 B2
(45) Date of Patent: Dec. 11, 2012

(54) IN SITU THERMAL PROCESS FOR RECOVERING OIL FROM OIL SANDS

(75) Inventor: Gokhan Coskuner, Calgary (CA)

(73) Assignee: Husky Oil Operations Limited, Calgary, CA (US)

( * ) Notice: Subject to any disclaimer, the term of this patent is extended or adjusted under 35 U.S.C. 154(b) by 434 days.

(21) Appl. No.: 12/470,843

(22) Filed: May 22, 2009

(65) Prior Publication Data

US 2009/0288827 A1 Nov. 26, 2009

(30) Foreign Application Priority Data

May 22, 2008 (CA) ..... 2631977

(51) Int. Cl.
*E21B 43/24* (2006.01)

(52) U.S. Cl. ..... 166/272.3

(58) Field of Classification Search ..... 166/272.3, 166/272.7, 269, 245, 52, 303, 305.1
See application file for complete search history.

(56) References Cited

U.S. PATENT DOCUMENTS

| | | | | |
|---|---|---|---|---|
| 4,598,770 | A | 7/1986 | Shu et al. | |
| 5,273,111 | A | 12/1993 | Brannan et al. | |
| 5,318,124 | A | 6/1994 | Ong et al. | |
| 5,417,283 | A * | 5/1995 | Ejiogu et al. | 166/272.3 |
| 5,803,171 | A * | 9/1998 | McCaffery et al. | 166/245 |
| 5,860,475 | A * | 1/1999 | Ejiogu et al. | 166/245 |
| 6,257,334 | B1 * | 7/2001 | Cyr et al. | 166/272.7 |
| 6,662,872 | B2 * | 12/2003 | Gutek et al. | 166/272.4 |
| 2007/0295499 | A1 * | 12/2007 | Arthur et al. | 166/245 |
| 2008/0087425 | A1 | 4/2008 | Hsu et al. | |

FOREIGN PATENT DOCUMENTS

| | | |
|---|---|---|
| CA | 1304287 | 6/1992 |
| CA | 2251157 | 4/2000 |
| CA | 2277378 | 1/2001 |
| CA | 2325777 | 5/2002 |
| CA | 2330094 | 7/2002 |
| CA | 2574336 | 8/2007 |
| CA | 2549614 | 12/2007 |
| CA | 2593585 | 1/2008 |

* cited by examiner

*Primary Examiner* — Angela M DiTrani
*Assistant Examiner* — Silvana Runyan
(74) *Attorney, Agent, or Firm* — Ryan A. Schneider; Troutman Sanders LLP

(57) ABSTRACT

A method of recovering oil from an oil sands reservoir comprises first applying cyclic steam stimulation (CSS) to a series of generally horizontally extending wells in the reservoir; then applying steam assisted gravity drainage (SAGD) to at least one vertically-spaced well pair in which one well in each well pair is part of the series of wells to which CSS was applied, while producing oil from at least one single well in the series of wells. In this case, each single well is adjacent to and offset from at least one of the well pairs. The method can then further comprise applying a SAGD blowdown to an injector well of each well pair and producing oil from a producer well of each well pair and from the single well to economic limit.

14 Claims, 11 Drawing Sheets

| Case Name | Description | | | | | | |
|---|---|---|---|---|---|---|---|
| CASE | Process | SAGD well injection pressure kPa | CSS well injection pressure kPa | CSS Starts time after SAGD year | SAGD Starts time after CSS year | SAGD well injection rate m3/d | CSS well injection rate m3/d |
| Case 7-4 | Fast SAGD | 4000 | 11500 | 1 | NA | 400 | 1000 |
| Case 7-5 | Pure CSS | NA | 11500 | NA | NA | NA | 1000 |
| Case 7-6 | CSS-SAGD | 4000 | 11500 | NA | 3 CSS cycle | 400 | 1000 |
| Case 7-7 | Pure SAGD | 4000 | NA | NA | NA | 400 | NA |

| Case Name | Cum (Cut off @ ISOR=7/CSOR=4) | | | | | | |
|---|---|---|---|---|---|---|---|
| CASE | **Steam** m3 | **Oil** m3 | **Water** m3 | **Gas** m3 | **Steam oil Ratio** m3/m3 | **Oil Recovery factor** % | **Well life** year |
| Case 7-4 | 2.03E+06 | 547890 | 1.97E+06 | 3.46E+06 | 3.7 | 73.7 | 15 |
| Case 7-5 | 2.07E+06 | 556486 | 2.00E+06 | 3.09E+06 | 3.7 | 74.9 | 11 |
| Case 7-6 | 2.00E+06 | 571529 | 1.91E+06 | 4.71E+06 | 3.5 | 76.9 | 11 |
| Case 7-7 | 1.87E+06 | 467792 | 1.86E+06 | 776726 | 4.0 | 62.9 | 20 |

FIGURE 6

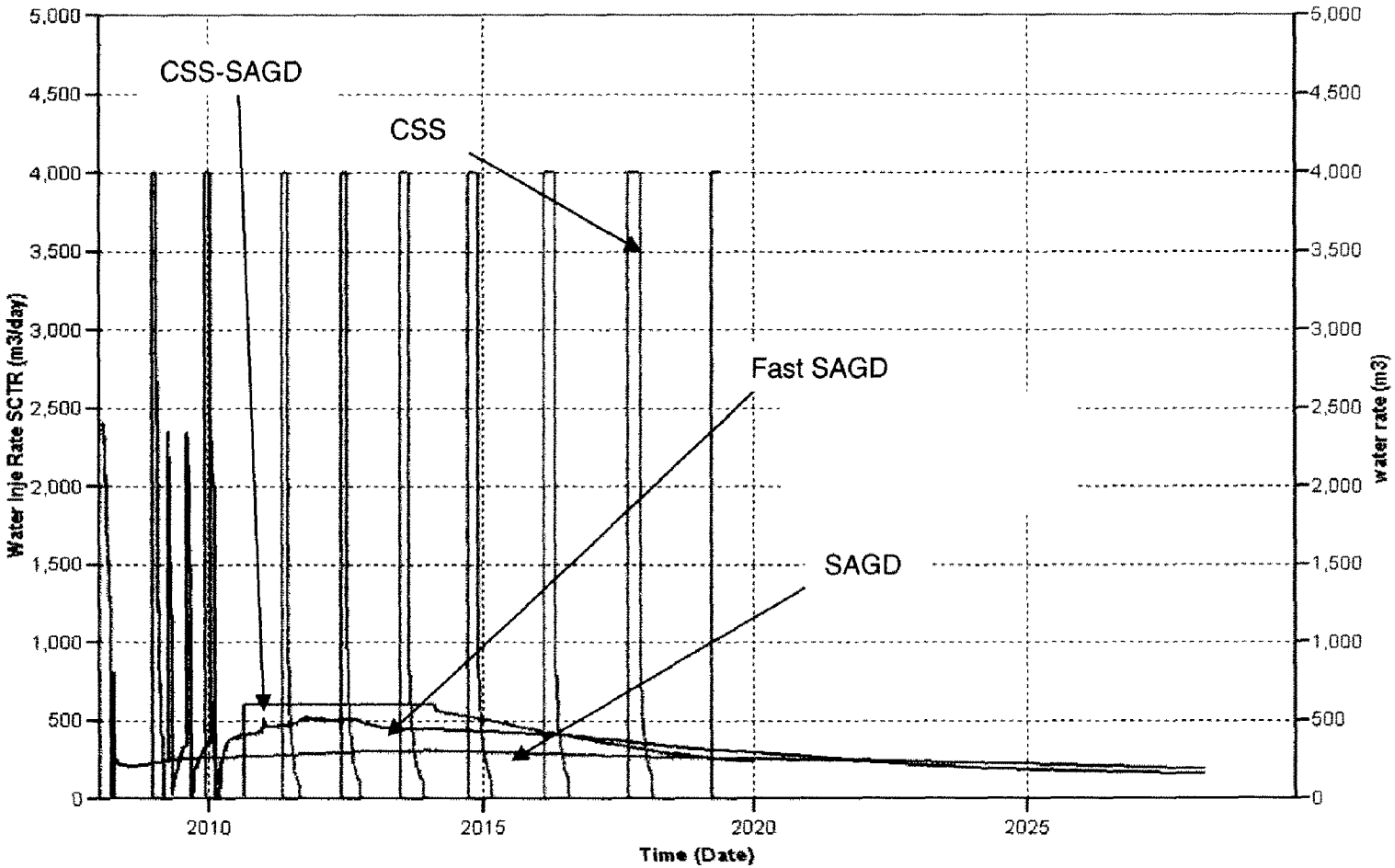
Figure 7 Comparison of steam injection rate of Pure SAGD, Fast SAGD, CSS and SAGD

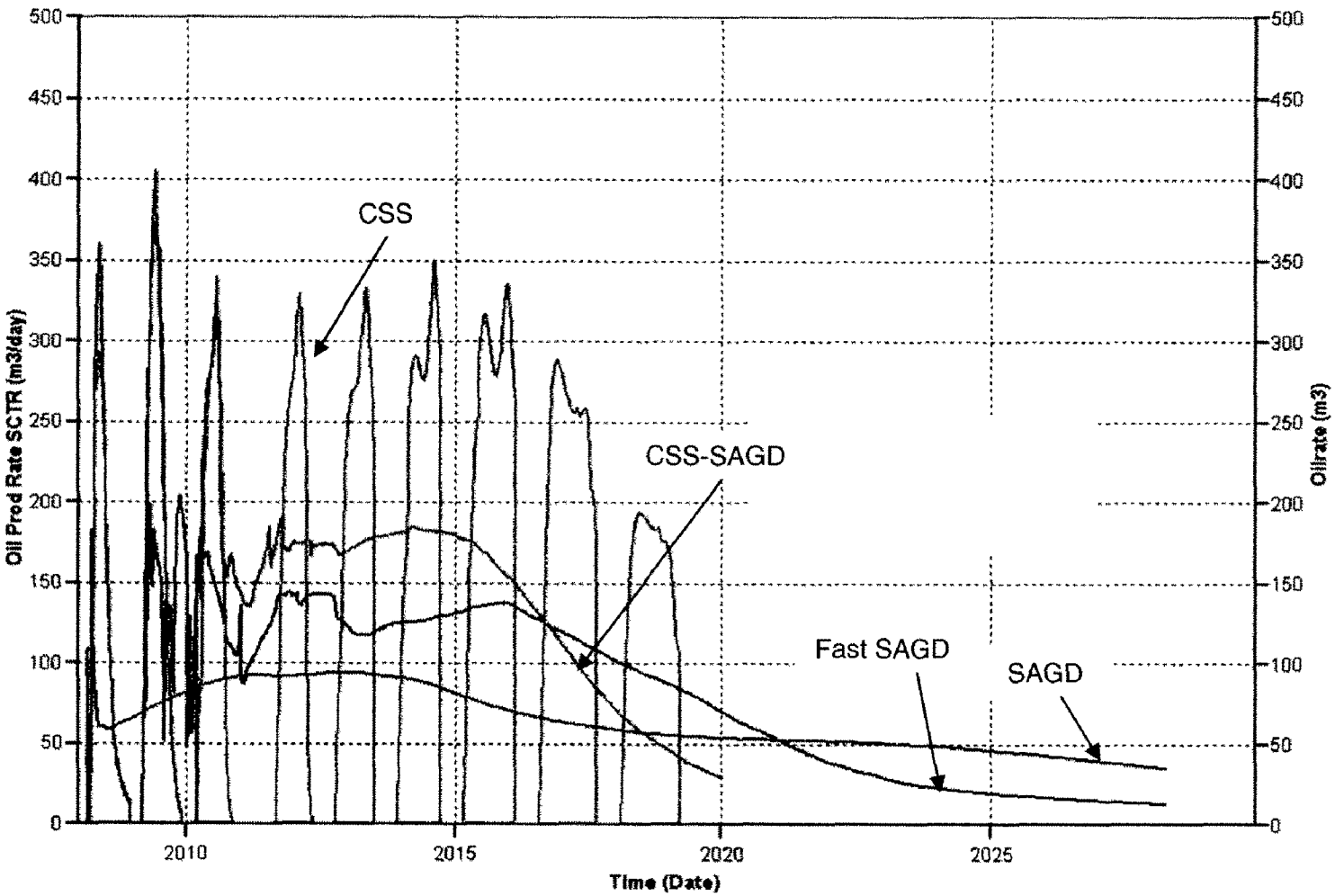
Figure 8 Comparison of oil production rate of Pure SAGD, Fast SAGD, CSS and SAGD

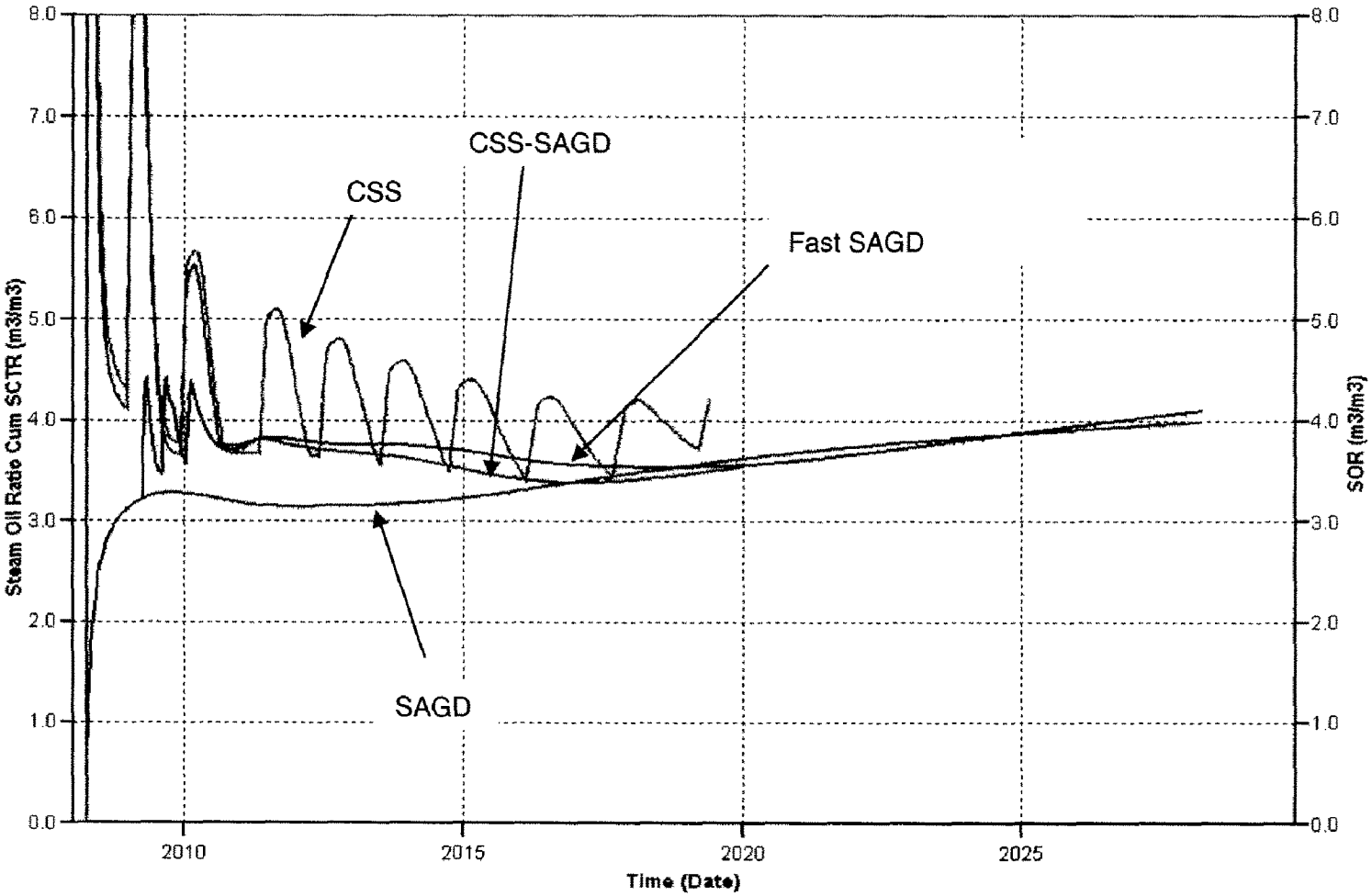
Figure 9 Comparison of SOR of Pure SAGD, Fast SAGD, CSS and SAGD

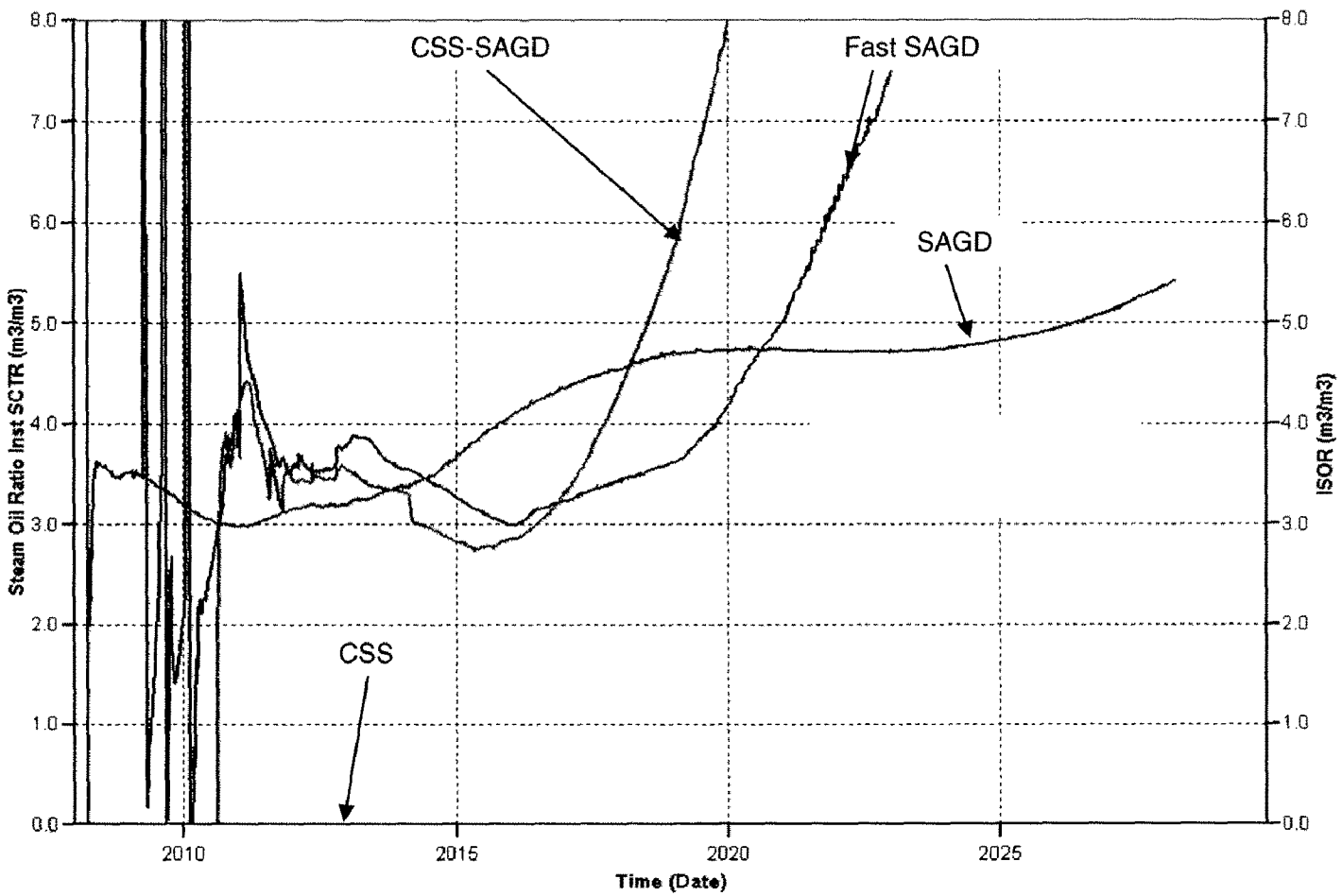
Figure 10 Comparison of ISOR of Pure SAGD, Fast SAGD, CSS and SAGD

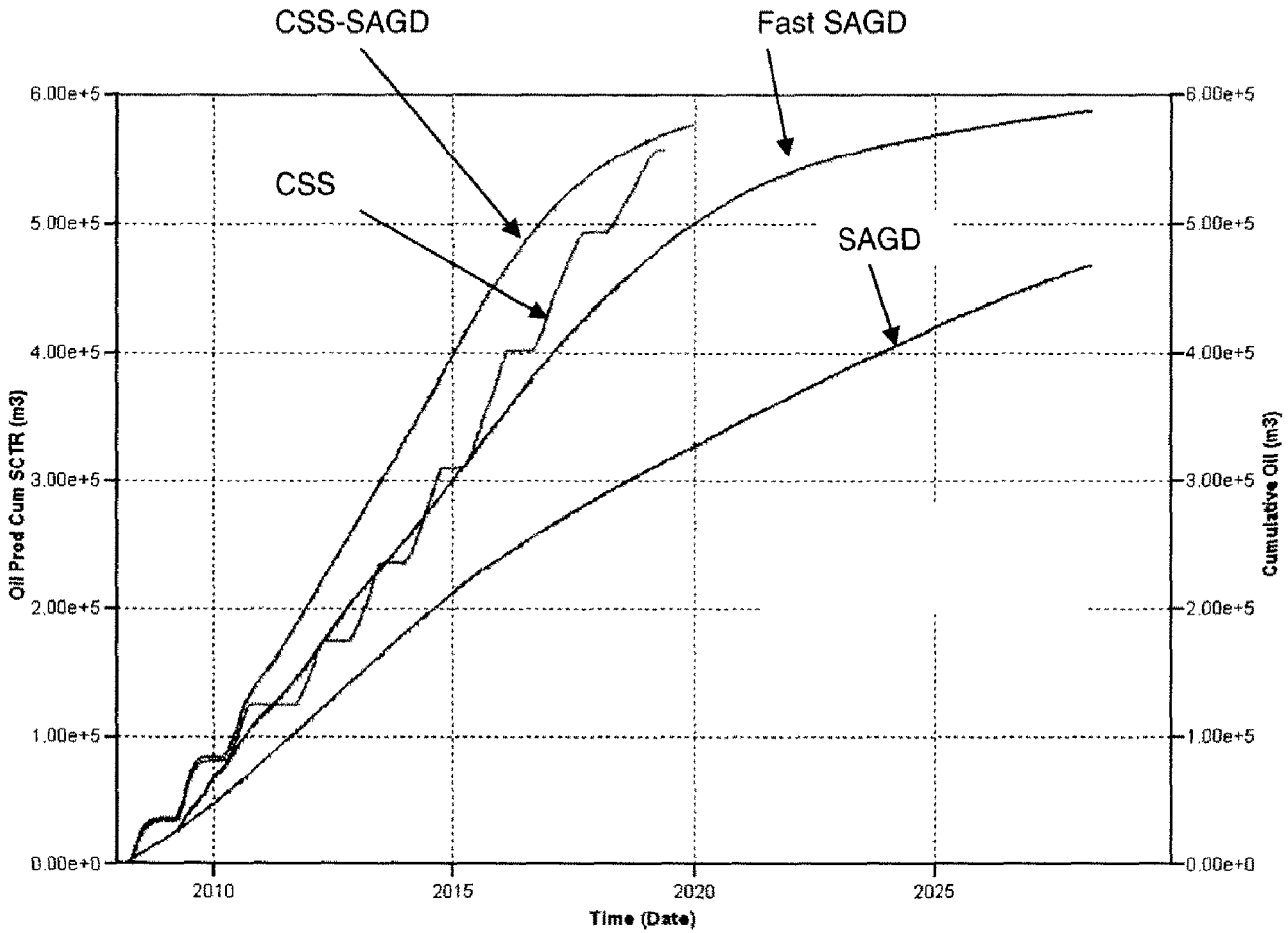
Figure 11 Comparison of cumulative oil of SAGD, Fast SAGD, Pure CSS and Husky SAGD

IN SITU THERMAL PROCESS FOR RECOVERING OIL FROM OIL SANDS

CROSS-REFERENCE TO RELATED APPLICATIONS

This application is based on, and claims the benefit of priority to, CA application 2,631,977, filed 22 May 2008, which priority application is hereby incorporated by reference.

FIELD OF THE INVENTION

This invention relates generally to an in situ thermal process and system for recovering oil from an oil sands reservoir.

BACKGROUND

Bituminous sands, commonly referred to as oil sands or tar sands, are a mixture of sand or clay, water, and bitumen. While tar sand deposits can be found in a number of different places in the world, the largest tar sand deposits are found in Canada. Most of the Canadian tar sands are located in three major deposits in northern Alberta. Some estimate the Alberta tar sands deposits to contain at least 85% of the world's total reserves of natural bitumen that are concentrated enough to be economically recoverable for conversion to oil at current prices.

Bitumen in its raw state is a heavy viscous crude oil which contains a high amount of sulfur. Because of this high viscosity, bitumen will not flow at reservoir conditions. The two most common bitumen production techniques currently employed are surface mining and in situ thermal recovery.

The largest bitumen deposit in Canada, containing about 80% of Canada's bitumen supply, and the only one suitable for surface mining is the Athabasca Oil Sands along the Athabasca River in Alberta. A smaller deposit is found in the Cold Lake region in Alberta, and is notable for having oil that is fluid enough to be extracted by conventional methods in some places. These Alberta areas are also suitable for bitumen production using known in-situ thermal methods such as cyclic steam stimulation (CSS) and steam assisted gravity drainage (SAGD). These in situ operations involve drilling wells and injecting steam to heat the bitumen allowing it to flow and to be produced from a well.

The use of steam injection to recover heavy oil has been in use in the oil fields of California since the 1950s and is presently being used in several locations in Alberta. CSS, also known as "huff-and-puff" or steam stimulation involves alternately injecting, soaking and producing in a single well. This technique is popular in fields where oil mobility is too low to begin steam flooding immediately. In conventional CSS, steam is first injected into a well at a temperature of 300 to 340 degrees Celsius and at a pressure up to 2000 psi for a period of weeks to months to heat the bitumen ("injection" or the "huff"). The well is then allowed to sit for days to weeks to allow heat to soak into the formation ("soak"). Then, hot water and bitumen are pumped out of the well for a period of weeks or months ("production" or the "puff"). Once the production rate falls off, the well is put through another cycle of injection, soak and production. This process is repeated until the cost of injecting steam becomes uneconomic relative to the money made from producing oil.

SAGD was developed in the 1980s by an Alberta government research center and is now widely used in a number of new in situ projects. In conventional SAGD, a pair of horizontal wells are drilled in the tar sands, with one about 5 meters above the other. Initially, the area around and between the upper well ("injector well") and the lower well ("producer well") is warmed up by circulating steam through both wells; during this initial warming up, oil is not produced in commercially significant quantities. Following this, in each well pair, pressurized steam is injected into the injector well, and the heat from the steam melts the bitumen within the heated area or "steam chamber" formed by the steam. The bitumen then flows via gravity into the producer well, where it is pumped to the surface. Each well pair can produce up to 1000 to 1500 barrels per day and are typically spaced 100 to 200 m apart.

SAGD offers several significant advantages over CSS. CSS will typically recover 25-30% of the original bitumen in place over the life of the process, and requires steam to be provided at a higher pressure than SAGD. In contrast, SAGD can recover 60 to 70% of the bitumen in a more efficient manner: for CSS, the steam-oil-ratio ("SOR") which measures the volume of steam required to extract the bitumen is between 3.0 and 6.0 for CSS and only 2.0 to 3.0 for SAGD. Therefore, significantly less energy, typically in the form of natural gas, is required to generate the steam necessary for the SAGD process.

While SAGD represents a technological advance in certain aspects of recovering oil from tar sands, it is not without its disadvantages. Because this technique relies on gravity for drainage, the process works best in relatively thick and homogeneous clean oil sand reservoirs. CSS in comparison, has been successfully employed in more diverse environments, and is more tolerant than SAGD to variations in reservoir quality.

Another variation of SAGD is known as "Fast-SAGD" has been disclosed, for example, by Polikar et al in H. Shin and M. Polikar, "Review of Reservoir Parameters to Optimize SAGD and Fast-SAGD Operating Conditions", JCPT Vol. 46, No. 1, January 2007, in U.S. Pat. No. 6,257,334, and by Polikar, M. Cyr, T. J. and Coates, R. M., in "Fast-SAGD: Half the Wells and 30% Less Steam", Paper No. SPE 65509/PS2000-148, Proc. 4th International Conference on Horizontal Well Technology, Calgary, Alberta (Nov. 6-8, 2000). In Fast-SAGD as disclosed by these publications, an extra single horizontal well is placed between two SAGD well pairs. While the SAGD process is implemented at the SAGD well pairs, steam is injected at higher pressures into the single horizontal well in a cyclic mode in order to help propagate the steam chambers laterally along with the SAGD operation. After several steam cycles at the single well, the single well and SAGD wells are in thermal communication. Then, the single well is converted to production for the remainder of its well life. Meanwhile, steam injection continues into each SAGD injector well to maintain and expand the existing steam chamber, resulting in additional production compared to a convention SAGD operation.

As of the present writing, the proposed Fast-SAGD process has only been simulated and not field tested. The known simulations have only been conducted in idealized reservoirs with uniform properties. Further, the simulations have only been conducted using a two-dimensional vertical cross-section of a reservoir. As a result, the simulations have not taken into consideration the effects of variations in reservoir properties in the cross-section dimensions as well as in the direction of the horizontal wells. It is expected that Fast-SAGD will be problematic in real reservoirs with areal and vertical permeability variations. In nature, every oil sand accumulation will have a certain variation in permeability areally as well as vertically. The CSS wells in the Fast SAGD process operate at pressures that are significantly higher than the SAGD well pairs. The large pressure difference between the CSS and the SAGD wells eventually creates a short circuit between the two wells at which point the process has to be converted to conventional SAGD operation thereby reducing significantly the advantage that would be provided by the CSS well. FIG. 1 (Prior Art) shows a 3-dimensional simulation of a Fast-SAGD operation in the Clearwater Formation in the Cold Lake area of Alberta; data from the Cold Lake area representing actual reservoir permeability variations were used in this simulation. In this simulation, a short circuit has occurred between two adjacent wells on the left. That is, there is steam breakthrough from a CSS well on the left boundary of the model to an adjacent SAGD well. As there is a pressure differential between the CSS well and the SAGD wells, all of the steam will flow through the breakthrough instead of contributing to continued expansion of the steam chamber. Therefore, the process is converted to a SAGD operation at this point. It is further noted that the additional heated area provided by the CSS wells are far smaller than that would be expected as prescribed in the literature. The process performs better than a pure SAGD operation would due to an additional producer between the SAGD well pairs, but the expected performance is not reached. It is quite likely that the additional cost of CSS wells will not be worth while in this case. Consequently, the Fast SAGD process may have little practical application in real world applications.

With current in situ technologies, the tar sands in Alberta place Canada on par with Saudi Arabia in volume of recoverable oil reserves. Canada is already the largest supplier of crude oil and refined products to the U.S., with over a million barrels per day coming from tar sands. With the recent dramatic increases in oil prices and political volatility in the Middle East, there is strong motivation to develop even more efficient and effective technologies to recover oil from tar sands.

SUMMARY OF THE INVENTION

It is an object of the invention to provide a solution to at least some of the deficiencies in the prior art, and in particular to provide an improved in situ thermal process for recovering oil from a tar sands reservoir.

According to one aspect of the invention, there is provided a method of recovering oil from an oil sands reservoir comprising first applying cyclic steam stimulation (CSS) to a series of generally horizontally extending wells in the reservoir; then applying steam assisted gravity drainage (SAGD) to a vertically-spaced well pair in which one well in the well pair is part of the series of wells to which CSS was applied, while producing oil from a single well in the series of wells to which CSS was applied. The single well is laterally spaced from the well pair without any other well therebetween. According to an alternative aspect of the invention, the single well and the well pair can form one group in a repeating group of wells. According to another alternative aspect of the invention, the single well does not form part of a second SAGD well pair, the second SAGD well pair including a well other than the single well and the well pair. According to a further alternative aspect of the invention, in the step of applying SAGD to the well pair, the single well produces oil primarily as a result of SAGD being applied to the well pair.

The method can then further comprise applying a SAGD blowdown to an injector well of each well pair and producing oil from a producer well of each well pair or from the single well or from both the producer well and single well to economic limit.

Both wells of each well pair can be present in the reservoir at the time CSS is applied to the series of wells. In such case, the CSS can be applied to the injector well of each well pair and in which case the producer well is shut in. Alternatively, the CSS can be applied to the producer well of each well pair and in which case the injector well is shut in. The series of wells can comprise an alternating pattern of vertically spaced well pairs and adjacent and offset single wells, wherein the single wells are located at a depth between above the height of the injector well in the well pair by 50% of the vertical spacing between the well pair and below the producer well in the well pair by 50% of the vertical spacing between the well pair.

Alternatively, only one well in each well pair is present in the reservoir at the time CSS is applied to the series of wells. In such case, the other well in each well pair is drilled into the reservoir after CSS is applied but before SAGD is applied. The wells in the series of wells to which CSS was applied can be substantially at the same depth to form an in-line formation; in such case, the wells that are later drilled into the reservoir are each located above a well in the series of wells to form a well pair. Alternatively, the wells in the series of wells to which CSS was applied can alternate between a higher depth and a lower depth to form a staggered formation; in such case, the wells that are later drilled into the reservoir are each located below a well at the higher depth to form a well pair.

The CSS that is applied to the series of wells can comprise multiple cycles, and preferably between one and three cycles. The selected number of cycles will depend on a number of factors such as the properties of the reservoir in which the process is carried out and the well spacing.

In the step of applying CSS to a series of wells, steam can be injected at substantially the same pressure to each well in the series of wells.

BRIEF DESCRIPTION OF THE FIGURES

FIG. 3(*b*) is a side elevation view of the wells shown in FIG. 1 subjected to an initial CSS stage of the CSS-SAGD process, wherein a producer well of the well pair and the single well is subjected to steam injection.

FIG. 4(*b*) is a side elevation view of a series of wells in an in-line formation subjected to an initial CSS stage, with future wells to be drilled above some of the wells to form well pairs shown in stippled line.

FIG. 6 is a table of operating parameters and oil production results of conventional CSS, SAGD, and Fast-SAGD processes and the CSS-SAGD process.

FIG. 7 is a graph comparing the steam injection rate of conventional CSS, SAGD, and Fast-SAGD processes and the CSS-SAGD process.

FIG. 8 is a graph comparing the oil production rate of conventional CSS, SAGD, and Fast-SAGD processes and the CSS-SAGD process.

FIG. 9 is a graph comparing the cumulative steam-oil ratio of conventional CSS, SAGD, and Fast-SAGD processes and the CSS-SAGD process.

FIG. 10 is a graph comparing the instantaneous steam-oil ratio of conventional CSS, SAGD, and Fast-SAGD processes and the CSS-SAGD process.

FIG. 11 is a graph comparing the cumulative oil production of conventional CSS, SAGD, and Fast-SAGD processes and the CSS-SAGD process.

DETAILED DESCRIPTION OF EMBODIMENTS OF THE INVENTION

Structure

Figure 1:
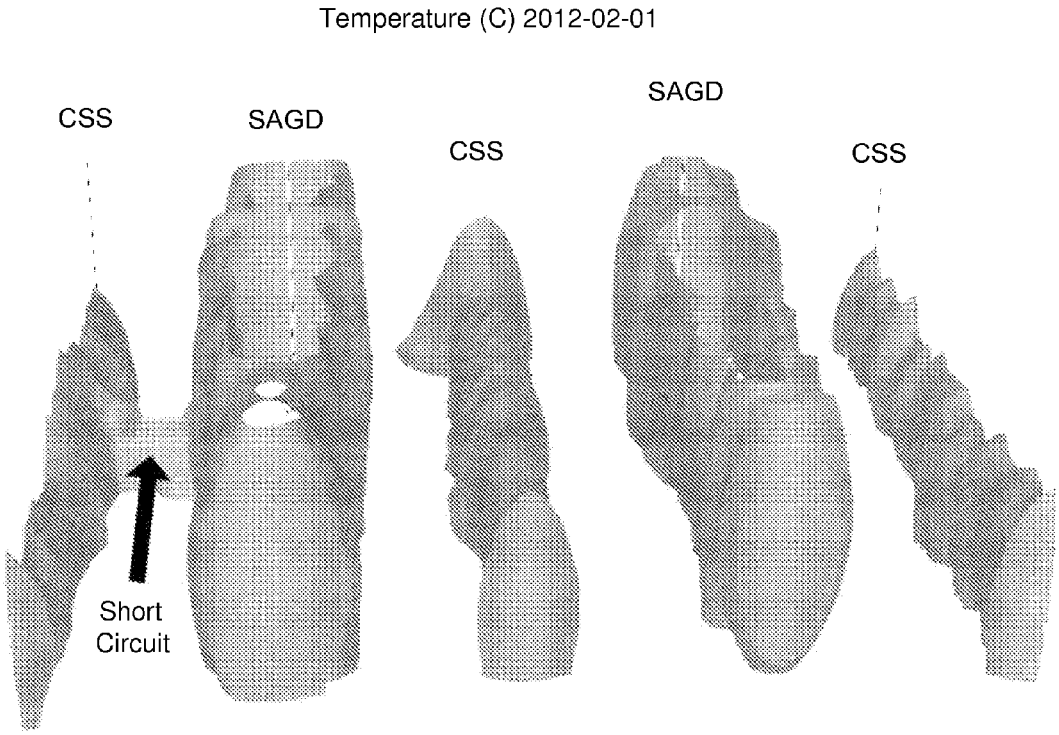
Figure 1 (Prior Art)
FIG. 1 is a perspective view of a series of wells in a Fast-SAGD operation showing the zone heated by steam to at least 100° C. (PRIOR ART)
Figure 2:
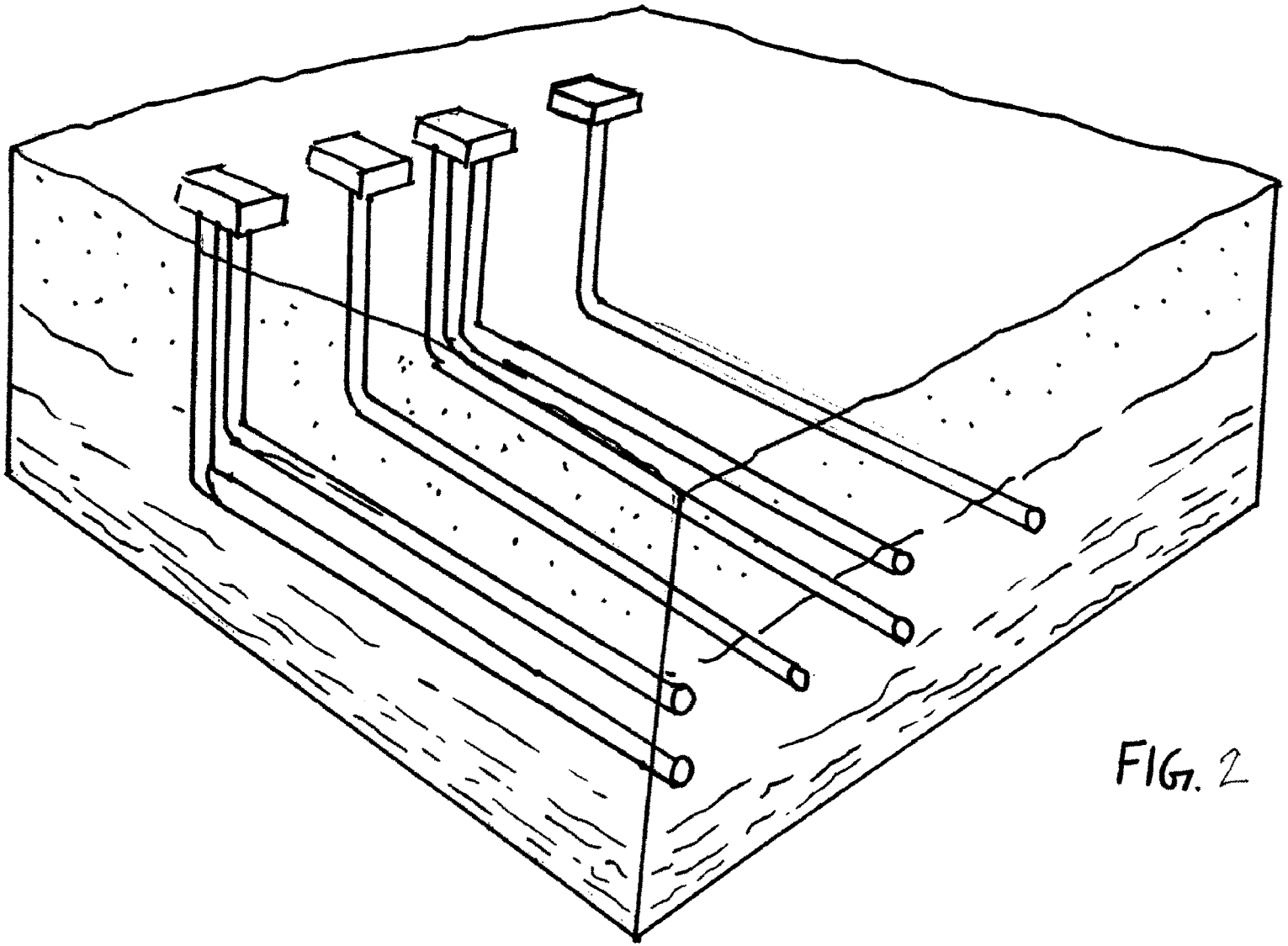
FIG. 2 is a schematic perspective view of a series of wells used in an in situ thermal process ("CSS-SAGD process") according to an embodiment of the invention, wherein some of the wells are vertically offset well pairs and other wells are single offset wells.

According to one embodiment of the invention and referring to FIG. 2, multiple wells are drilled into a tar sands reservoir, and an in situ thermal process is carried out in these wells to recover oil from the tar sands. This thermal process utilizes aspects of both CSS and SAGD, and produces oil in a more cost efficient and effective manner than each of these known in situ thermal processes as will be described in detail below. For convenient reference the thermal process of this embodiment is hereinafter referred to as "CSS-SAGD process".

The CSS-SAGD process can be carried out in tar sand reservoirs that are heterogeneous. For example, the CSS-SAGD process can be used in a reservoir such as the Clearwater formation of the Caribou reservoir at Cold Lake, Alberta. However it is also understood that the CSS-SAGD process can be used in any other tar sand reservoirs having different properties.

The Caribou reservoir is 20 to 32 meters thick and has intermittent layers of shale, breccias and low permeability calcites. The Caribou reservoir has bitumen of 10.9° API gravity with a solution gas-oil ratio of 8.0 $m^3/m^3$. The estimated bubble point pressure is 2,650 kPa, the gas specific gravity is 0.65, and the connate water has a total dissolved solid content of 8,889 mg/L.

The wells extend from the surface downwards and then extend generally horizontally into the tar sand reservoir; for the Caribou reservoir, the wells would extend horizontally at about a depth of 425 meters. The horizontal portion of each well extends generally parallel to and are spaced from the horizontally-extending portions of the other wells. The method of drilling such wells are the same as the methods used to drill SAGD and CSS wells, which are well known in the art and thus not described in detail here.

Figure 3A:
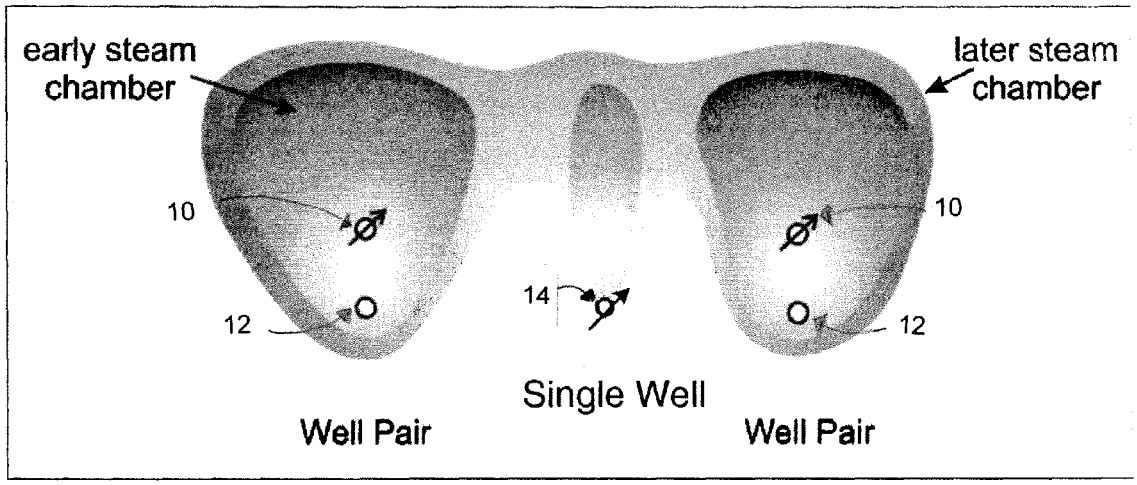
FIG. 3(*a*) is a side elevation view of the wells shown in FIG. 1 subjected to an initial CSS stage of the CSS-SAGD process, wherein an injector well of the well pair and the single well is subjected to steam injection.
Figure 3B:
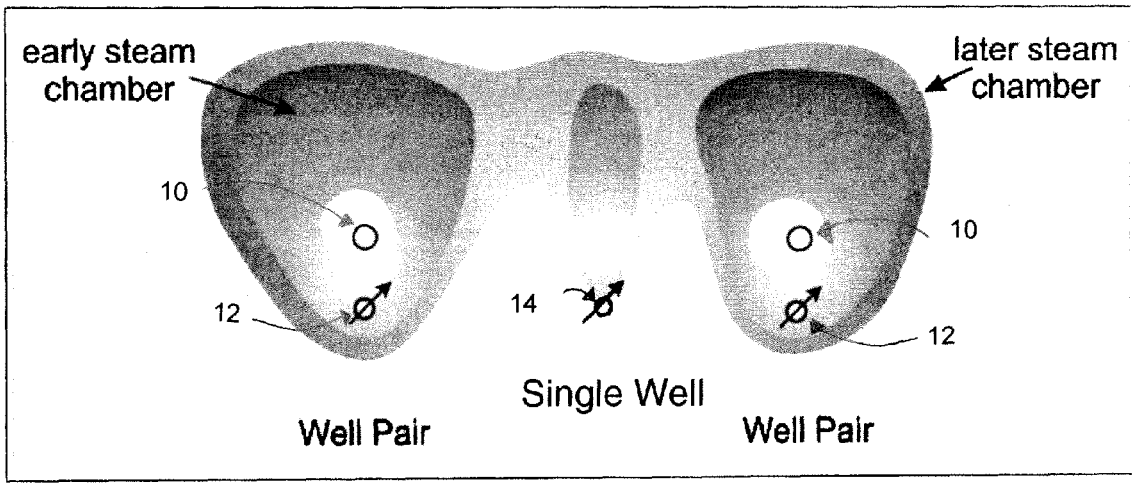

When viewing the wells in cross-section as in FIG. 3(*a*), the wells can be seen to form, along a horizontal plane, groups of wells each consisting of a vertically-spaced well pair comprising an injector well 10 and a producer well 12 and a single well 14 that is offset from and adjacent to the well pair 10, 12. Although FIG. 2 shows two such groups of wells, the CSS-SAGD process of this embodiment can employ a different number of groups, and can have any number of well groups following this pattern.

The single wells 14 are located at the same depth as the producer wells 12. Alternatively, the single wells can be located at a different depth, and can be located as high as a depth above the injector wells 10 that is 50% the vertical spacing between the well pairs 10, 12, and as low as a depth below the producer wells 14 that is 50% the vertical spacing between the well pairs 10, 12.

The well configuration of each well pair 10, 12 corresponds to a conventional SAGD well pair. The well configuration of the offset single well 14 corresponds to a conventional CSS well. The well configurations of the wells 10, 12, 14 will depend on the geological properties of the particular tar sand reservoir and the operating parameters of the SAGD and CSS processes, as is well known to one skilled in the art. The spacing between each well pair 10, 12 and offset single well 14 will also depend on the properties of the reservoir and the operating parameters of CSS-SAGD process; in particular, the spacing should be selected such that steam chambers from the injector well of the well pair and the single well can come into contact with each other within a reasonable amount of time so that the accelerated production aspect of the process is taken advantage of. For a medium quality location in the Caribou reservoir, a spacing of 50-75 meters was found to be suitable. The steam chambers come into contact within 3 to 4 years in the Caribou reservoir if the wells are spaced by 75 m.

Operation

After the wells 10, 12, 14 are in place, the CSS-SAGD process is carried out to recover oil from the tar sands reservoir. The CSS-SAGD process comprises three key operating stages:

- an "Initial CSS" stage, wherein the injector wells 10 (or producer wells 12 according to an alternative embodiment) and single wells 14 are operated as CSS wells for one or more cycles,
- a "SAGD operational stage" wherein a SAGD operation is applied to the well pairs 10, 12 and the single wells 14 are operated as production wells, i.e. where the steam is injected into injector wells 10 and the bitumen is produced from either one or both of the producer and single wells 12 and 14, and
- a "SAGD blowdown stage" wherein steam injection is terminated and the reservoir is produced to economic limit. Each of these steps are described in further detail below and in reference to the flowchart shown in FIG. 5.

Initial CSS Stage

Referring to FIG. 3(*a*), the first stage of the CSS-SAGD process is to carry out a CSS operation on the injector well 10 of each well pair 10, 12 and on each single well 14 while keeping the producer wells 12 shut in to develop the steam chamber of all of the wells 10, 12, 14, i.e. to cause the steam chambers of the wells 10, 12, 14 to overlap. This is known as a staggered CSS start, wherein the injector and single wells 10, 14 which form a staggered well pattern. Alternatively and referring to FIG. 3(*b*), CSS can be started in an in-line mode where the initial CSS operation is conducted on the producer wells 12, and single wells 14 while keeping the injector wells 10 shut in.

Figure 4A:
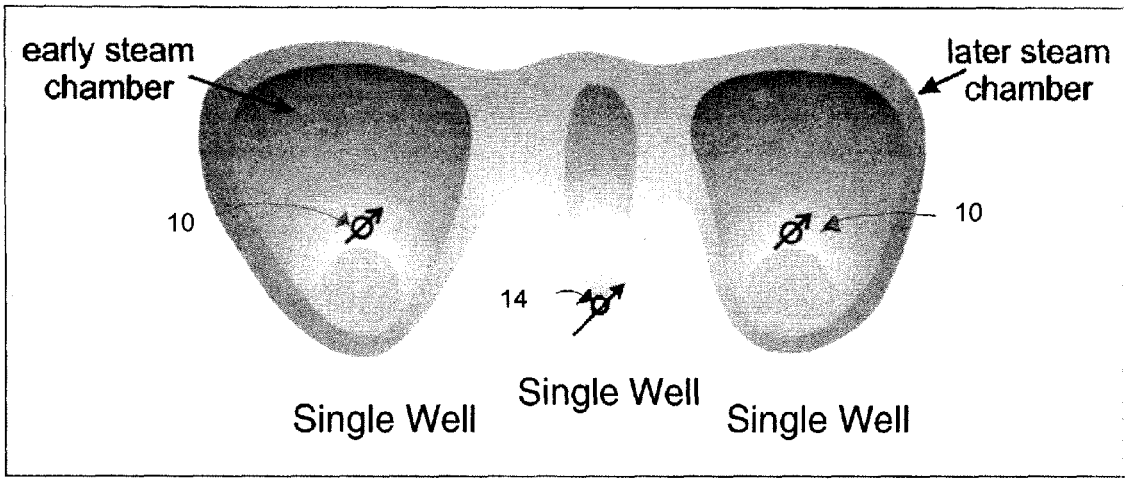
FIG. 4(*a*) is a side elevation view of a series of wells in staggered formation subjected to an initial CSS stage, with future wells to be drilled underneath some of the single wells to form well pairs shown in stippled line.
Figure 4B:
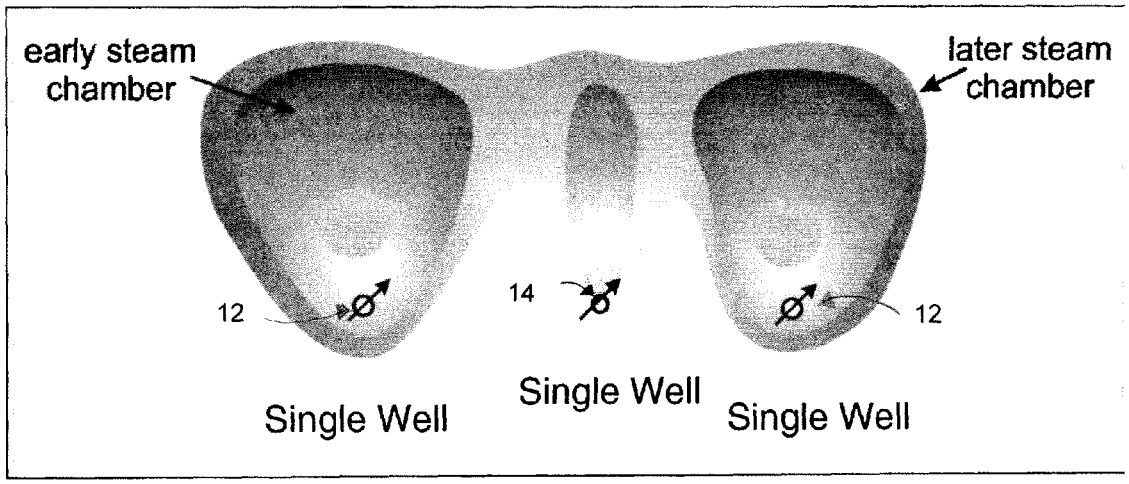

According to another embodiment of the invention and referring to FIGS. 4(*a*) and (*b*), the wells that were shut in at this stage in the embodiments shown in FIGS. 3(*a*) and (*b*) can instead be drilled after the CSS operation is finished to save initial capital spending if it is so desired. Therefore, for a staggered CSS start as shown in FIG. 4(*a*), only the injector wells 10 are initially drilled along with the single wells 14, forming a staggered line of wells. After the CSS operation, the producer wells 12 are drilled underneath each injector well 12 to form a well pair. For an in-line CSS start as shown in FIG.

4(*b*), only the producer wells 12 are initially drilled along with the single wells 14, forming an in-line line of wells. After CSS operation, the injector wells 10 are drilled above each producer well 12 to form well pairs. Or in the case of the staggered CSS start, the producer wells 12 are drilled below the injector wells 10 to form well pairs.

It has been found that in the early years of a well's life cycle, CSS is more productive than SAGD or Fast SAGD in heterogeneous formations. In particular, during this time, CSS has a higher energy efficiency than the Fast SAGD process; the CSS recovery process takes advantage of a variety of recovery mechanisms, including formation re-compaction, solution gas drive, fluid expansion, and a condensate's sensible heat and gravity drainage. CSS is also more tolerant than SAGD of low quality shale and tight streaks.

The initial CSS stage can comprise one or more CSS cycles. Each cycle can take several months to about a year. The number of CSS cycles applied depends on a number of factors including the reservoir properties and well spacing. For instance, in a good quality reservoir, the steam chambers will expand quickly and takes a relatively short period of time to overlap; thus, fewer CSS cycles are required for such wells. For a poor quality reservoir, the steam chambers will expand slowly and takes a relatively long period of time to overlap; thus more CSS cycles are required for such wells. For a good quality tar sands reservoir, one to three CSS cycles should be sufficient for the Initial CSS stage.

Figure 5:
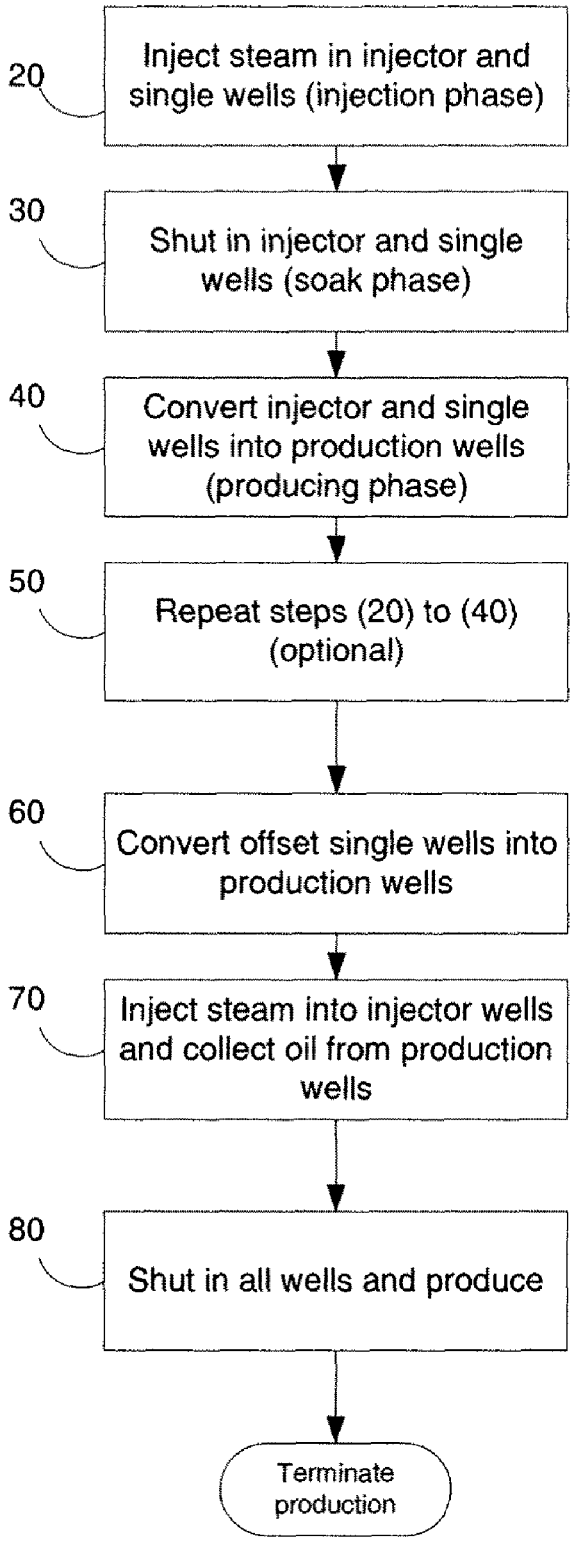
FIG. 5 is a flowchart of the steps performed in the CSS-SAGD process.

FIG. 5 is a flow chart which illustrates the different steps of the CSS-SAGD process according to the embodiment shown in FIG. 3(*a*). Steps 20 to 50 comprise the initial CSS stage. In step 20, steam is injected into the injector and single wells 10, 14 under the same pressure and for a selected period of time (injection phase). In step 30, the injector and single wells 10, 14 are shut in to soak (soak phase). In step 40, the injector and single wells 10, 14 are converted into production wells and oil is extracted (producing phase). If additional CSS cycles are desired then steps 20 to 40 are repeated (step 50).

A number of operating parameters must be selected during the initial CSS stage. These parameters include steam injection pressure (MPa), maximum steam injection rate ($m^3$/day), steam injection period (days), soak period (days), maximum producer back pressure (MPa), maximum producer steam rate ($m^3$/day), producer total liquid rate ($m^3$/day), and production period (days). These parameters will vary depending on the characteristics of the wells and the reservoir; selection of suitable parameters will be known to one knowledgeable in CSS. For a typical installation at the Caribou reservoir, a suitable maximum injection pressure is 11.5 MPa at 321° C., a suitable steam injection rate is between 600-1000 $m^3$/day, a suitable producer minimum back pressure is 2 MPa, a suitable producer steam rate is 2 $m^3$/day, and a suitable total liquid production rate is 300 to 1000 $m^3$/day.

SAGD Operational Stage

After CSS was performed for the selected number of cycles, the CSS stage is terminated and the next stage of the CSS-SAGD process begins. In this "SAGD operational stage", the offset single wells are converted to dedicated production wells (step 60). Then, steam is injected into the injector well 10 of each well pair 10, 12 (step 70); since the surroundings around each well pair 10, 12 were heated during the initial CSS stage, only a relatively short period of time passes before the producer well 12 of each well pair 10, 12 begins producing mobilized bitumen and condensed steam.

The injector wells 10 are injected with steam at a relatively low injection pressure compared to the injection pressures in the Initial CSS stage; for example, in a good quality part of the Caribou reservoir, a suitable injection pressure during the CSS stage is 11.5 MPa and a suitable injection pressure during the SAGD stage is 4 MPa. Other operating parameters that are selected during the SAGD operational stage are similar to conventional SAGD operation and include injector steam injection rate ($m^3$/day, producer operating back pressure (MPa), producer steam rate ($m^3$/day) and total liquid production rate ($m^3$/day) of the production well 12 and the CSS well 14 which operates in a production mode at this stage. The operating parameters will vary depending on the reservoir properties and other factors known to those skilled in the art; for a typical installation at the Caribou reservoir, an injector well steam injection rate is 300 to 1000 $m^3$/day, a suitable production well minimum back pressure is 1 to 2 MPa, a suitable production well steam rate is 2 to 25 $m^3$/day, a suitable total liquid production rate is 300 to 1000 $m^3$/day.

The SAGD stage can be broken down into sub-stages: lateral expansion, overlapping, and downward expansion. During the lateral expansion stage, when steam is continuously injected into the injector wells 10, the steam chamber of the well pairs 10, 12 will expand laterally. A large steam zone is formed above the injector well by the rising steam when the steam chambers of the well pairs and off-set single wells overlap (previously produced during the Initial CSS stage). As a result, dramatic increases in bitumen production and water production rates have been observed, and which are indications of a good combining process.

As can be seen in FIG. 3(*a*), the steam chamber of each well pair is now connected to the steam chamber of its neighboring single wells. The well pair steam chamber will continue to expand and move downwards. Steam drive becomes an additional recovery mechanism in the recovery of bitumen from the offset single well. When less cold bitumen is available for heating, the steam requirement is sharply reduced. On the production side, bitumen production is observed to decline as well, however, at a more gentle rate. After a certain period of time (about 64 months a typical installation at the Caribou reservoir), the bitumen decline rate increases abruptly as the hydrostatic head is diminished in the reservoir.

The SAGD operational stage takes about nine years in a typical installation at the Caribou reservoir.

SAGD Blowdown Stage

This stage takes about two years and is similar to a conventional SAGD blowdown. As the instantaneous steam oil ratio goes beyond the economic limit, all the steam injection will be terminated and the injector wells 10 are shut in (step 80). Hot bitumen will continue to drain to producer wells 12 and single wells 14 and the SAGD chamber gradually cools. The blow down process will be similar to that which follows a conventional SAGD processes.

Assessment of CSS-SAGD Performance

The advantage of the CSS-SAGD process is that it initiates the production of both the injector well of each well pair and offset single wells with a CSS process conducted at the same pressure, which has been proven to be a successful recovery technique in the Clearwater formation of the Caribou area. The fact that the offset single wells 14 and injector wells 10 in the well pairs 10, 12 inject and produce at the same pressure concurrently, the tendency for the steam to short circuit from one well to the other is eliminated. With the SAGD process starting after a few CSS cycles, the production is accelerated. A mixed SAGD (in well pairs) and steam flooding (in offset single wells) can be considered as a follow-up process to the CSS operation. This provides a greater amount of flexibility and accelerated bitumen recovery in field implementation. Also, and importantly from an economic point of view, it may allow the operator to delay the drilling of the remaining well of SAGD well pairs as shown in FIGS. 4(*a*) and (*b*) and described above.

Example

Simulations of the CSS-SAGD process were performed using reservoir simulation models of a well location in the Caribou reservoir in Alberta, Canada. These simulations were compared to simulations of conventional CSS, SAGD, and Fast-SAGD processes performed under the same conditions and using the same simulation model. A summary of the results of these simulations is provided in FIG. 6.

The reservoir simulation models were conducted using the Steam, Thermal and Advanced Processes Reservoir Simulator (STARS™) software by the Computer Modeling Group Ltd. (CMG). The reservoir simulation models a location in the Caribou reservoir. The reservoir simulation models are heterogeneous models created in Petrel™ modeling software, and which includes seismic information and well data (well logs and cores) taken from the Caribou reservoir. The grid size selected for all the simulations was 25×2×2 m. A sector model of an average quality reservoir was created which comprised two half single wells in the extremes of the models, one full single well in the middle and two full well pairs in between. The vertical spacing of the well pairs was 5 m. Simulations were carried out with a well spacing at 75 m. The average vertical well depths were 450 m The models were defined with the following initial rock property distribution parameters; note that permeabilitites and porosities are distributed honoring the real well data and using a geostatistical approach, the figures reported in this table are arithmetic averages.

TABLE 1

Initial Rock Properties of Caribou Sector Model

| Average PHI | KH i (mD) Arithmetic average | KH j (mD) Arithmetic average | KV (mD) Arithmetic average | Total pore volume (M $rm^3$) | Stock Tank Bitumen (M $rm^3$) | Total water (M $rm^3$) | Total Gas (M $rm^3$) |
|---|---|---|---|---|---|---|---|
| 0.2488 | 1146 | 1228 | 591 | 5562 | 3965 | 1514 | 31558 |

The reservoir fluid properties of the bitumen are: 10.9° API gravity with a solution gas-oil ratio of 8.0 $m^3/m^3$. The gas specific gravity is 0.65 and the water has a total dissolved content of 8,889 mg/L, and the initial pressure was 2800 Kpa at a datum depth of 224 m below sea level.

The "Components" section of CMG's Builder program calculates the PVT parameters of the reservoir. A reservoir temperature of 15° C. and maximum pressure of 15,000 Kpa were used to calculate the PVT parameters. The "Quick Fluid Model" option and the "Blackoil" correlations were used to generate a blackoil type PVT that was then converted into a thermal PVT using the "Import BlackOil" option in Builder (STARS). The solution GOR is 8.0 $m^3/m^3$ at initial reservoir temperature and pressure. The oil formation factor at bubble point pressure and reservoir temperature is 1.018 $m^3/m^3$.

Another parameter of the simulation is the oil viscosity of the reservoir; in general, oil viscosity reduces with an increase in temperature. The oil viscosity varies from 143557.8 cP at 15° C. (reservoir conditions) to 2.8 at 300° C. (steam injection temperatures). A number of oil samples from stratigraphic wells in the Caribou area were tested and analyzed. For live oil viscosity, the simulator used the dead oil viscosity, a pseudo-solution of gas viscosity for the dissolved gas, and a logarithm mixing rule.

Another parameter of the simulator is the oil/water and oil/steam relative permeabilities of the reservoir. Relative permeability measurements were taken in the laboratory on Caribou Lake cores. Relative permeabilities are affected by temperature changes in a rock system under thermal recovery; the general trend is that the residual oil saturation decreases and the irreducible water saturation increases with an increase in temperature. Relative permeability curves were generated for three different temperatures (15° C., 175° C. and 335° C.)

The dilation option of STARS was utilized with following parameters:

Rock Mechanics Model: Dilation-Recompaction

| | |
|---|---|
| Reference pressure | 2800. kPa |
| Dilation onset pressure | 9000. kPa |
| Recompaction onset pressure | 5000. kPa |
| Dilation rock compressibility | 2.900E−04 1/kPa |
| Residual dilation fraction | 0.4500 |
| Porosity ratio maximum | 1.250 |

As there was an expectation that horizontal fractures would be preferentially induced by cyclic steaming at fracture pressures in the reservoir, horizontal permeability multiplier of 50 was applied to the fracture layer in the STARS program.

TABLE 2

Reservoir parameters

| | |
|---|---|
| Reservoir top depth | 445-450 m |
| Reservoir pressure | 2800 kPa |
| Reservoir temperature | 15 C. |
| Porosity | 0.18-0.33 |
| Bitumen saturation (So) | 0.5-0.76 |
| Permeability ratio (kv/kh) | 0.6 |
| Methane gas mole fraction | 15% |
| Capillary pressure | 0 kPa |
| Rock compressibility | 2.90E−06 1/kPa |
| Formation heat capacity | 2.35E+06 J/(m3*C.) |
| Rock thermal conductivity | 6.60E+05 J/m-d-C. |
| Oil thermal conductivity | 1.25E+04 J/m-d-C. |
| Water thermal conductivity | 5.35E+04 J/m-d-C. |
| Gas thermal conductivity | 3.20E+03 J/m-d-C. |
| Bitumen viscosity at 20 C. | 70,813.10 cp |

The simulations were carried out with an objective to confirm that the CSS-SAGD process is feasible and provides the expected advantages over the conventional CSS, SAGD and Fast-SAGD processes. In this connection and referring to FIG. 6, the four processes were simulated under the same conditions (where applicable). In particular, the injector wells and single wells of the CSS-SAGD process (initial CSS stage), and the CSS wells of the conventional CSS and Fast SAGD processes were subjected to 11500 kPa steam pressure at a rate of 1000 $m^3$/day. Similarly, the injector wells of the CSS-SAGD process (SAGD stage) and of the conventional SAGD and Fast-SAGD process were subjected to a SAGD well injection pressure of 4000 kPa at 400 $m^3$/day. In this simulation, CSS was started one year after SAGD in the Fast-SAGD process, and three CSS cycles were performed in the initial CSS stage of the CSS-SAGD process.

The four processes were carried out until either the instantaneous SOR reached 7 or cumulative SOR reached 4 ("economic limits").

Results are shown under the "Cumulative" columns in FIG. 6, in which "Steam" refers to the cumulative steam injected over the life of the wells, "Oil" refers to the cumulative oil produced over the life of the wells, "Water" refers to the total water produced over the life of the wells, "Gas" refers to the total natural gas produced over the life of the wells, "SOR" refers to the steam-oil ratio over the life of the wells, and "Oil Recovery Factor" refers the total oil produced as a percentage of the total theoretical oil available in the reservoir. The well life is dictated by when the processes reached the defined economic limits.

Referring to the oil production results shown in FIG. 6, the CSS-SAGD cumulative amount of steam used in the CSS-SAGD is comparable to the other three processes, and CSS-SAGD has the highest amount of oil and gas produced, the highest oil recovery factor, as well as the lowest SOR and well life. As will be seen more clearly in FIGS. 7 to 11, the time required to achieve the reported recoveries is significantly shorter for CSS-SAGD. For example, it will be shown that the while it takes 21 years to recover the value reported for the Fast-SAGD, it takes only 12 years to recover more oil with CSS-SAGD process.

FIGS. 7 to 11 are graphs of various characteristics of the four processes over the life of the wells. In particular, FIG. 7 compares steam injection rate, FIG. 8 compares oil production rate, FIG. 9 compares cumulative steam oil ratio (SOR), FIG. 10 compares instantaneous SOR, and FIG. 11 compares cumulative oil production of the four processes. As expected, the CSS-SAGD processes resembles the conventional CSS process in the first phase of the CSS-SAGD process, which in this simulation is about 3 years, from 2008 to 2011. In particular, FIGS. 7 and 8 show that the oil rate and steam injection of the CSS-SAGD process are substantially identical to the conventional CSS process in the first two cycles. Then the oil production rate has a big jump compared with conventional SAGD following the third cycle. This high rate continues over next five years. As the oil rate of Fast SAGD is low in early period, the cumulative oil of Fast SAGD remains always lower than the CSS-SAGD process. Yet, the Fast SAGD process exceeds the conventional CSS process after four and a half years. As mentioned above, CSS is more efficient in its early cycles. FIGS. 9 and 10 show the cumulative SOR (CSOR) and ISOR of the four processes. It can be seen that Fast SAGD has the highest cumulative SOR over most of production period. Nevertheless, CSS and CSS-SAGD have similar CSOR. Though SAGD has the lowest SOR, it also has the lowest oil production rate.

It is interesting to note from FIG. 11 that the cumulative oil production rate of the CSS-SAGD process is significantly higher than all three conventional process, especially after the CSS-SAGD processes enters into its second phase, i.e. the SAGD phase. It is also interesting to note that while all four process ultimate produce about the same total amount of oil before the economic limits are reached, the CSS-SAGD process reaches economic limits significantly earlier than the conventional SAGD and Fast-SAGD, and has a consistently higher oil production rate than conventional CSS up to about 2017. In other words, the CSS-SAGD can realize the oil product more quickly and in greater quantities than the other three processes.

One or more currently preferred embodiments have been described by way of example. It will be apparent to persons skilled in the art that a number of variations and modifications can be made without departing from the scope of the invention as defined in the claims.

What is claimed is:

1. A method of recovering oil from an oil sands reservoir, comprising:

(a) applying cyclic steam stimulation (CSS) to a series of generally horizontally extending wells in the reservoir, wherein the generally horizontally extending wells comprise a vertically-spaced well pair and said CSS is applied to at least one of the wells of the well pair; then (b) applying steam assisted gravity drainage (SAGD) to the vertically-spaced well pair; and (c) producing oil from a single well in the series of wells to which CSS was applied, the single well being laterally spaced from the well pair without any other well therebetween.

2. A method as claimed in claim 1 further comprising after (c): applying a SAGD blowdown to an injector well of the well pair and producing oil from a producer well of the well pair or from the single well or from both the producer well and the single well to economic limit.

3. A method as claimed in claim 1 wherein the series of wells comprise a repeating group of a vertically spaced well pair and a single well laterally spaced from the well pair with no well therebetween, wherein the well pair comprises an injector well and a producer well, and the single well is located at a depth that is between a range having an upper limit above the injector well by 50% of the vertical spacing between the well pair, and a lower limit below the producer well by 50% of the vertical spacing between the well pair.

4. A method as claimed in claim 1 wherein the CSS applied to the series of wells comprises between one and three cycles.

5. A method as claimed in claim 1 wherein in the step of applying CSS to a series of wells, steam is injected at substantially the same pressure to each well in the series of wells.

6. The method as claimed in claim 1 wherein the well pair extends generally horizontally.

7. A method as claimed in claim 1 wherein both wells of the well pair are present in the reservoir at the time CSS is applied to the series of wells.

8. A method as claimed in claim 7 wherein the well pair comprises an injector well and a producer well, and the CSS is applied to the injector well of the well pair and the producer well is shut in.

9. A method as claimed in claim 7 wherein the well pair comprises an injector well and a producer well, and the CSS is applied to the producer well of the well pair and the injector well is shut in.

10. A method of recovering oil from an oil sands reservoir, comprising:

(a) applying cyclic steam stimulation (CSS) to a series of generally horizontally extending wells in the reservoir;

(b) drilling a well into the reservoir to form a vertically-spaced well pair with one well in the series of wells to which CSS was applied in step (a);

(c) applying steam assisted gravity drainage (SAGD) to the vertically-spaced well pair; and (d) producing oil from a single well in the series of wells to which CSS was applied, the single well being laterally spaced from the well pair without any other well therebetween.

11. A method as claimed in claim 10 wherein the wells in the series of wells to which CSS was applied are substantially at the same depth to form an in-line formation, and the well drilled into the reservoir between steps (a) and (b) is located above a well in the series of wells to form the well pair.

12. A method as claimed in claim 10 wherein the wells in the series of wells to which CSS was applied alternate between a higher depth and a lower depth to form a staggered formation, and the well drilled into the reservoir between steps (a) and (b) is located below a well at the higher depth to form the well pair.

13. A method for recovering oil from an oil sands reservoir, the method comprising:

(a) drilling a series of generally horizontally extending wells in the oil sands reservoir, wherein the generally horizontally extending wells comprise a vertically-spaced well pair and a single well that is laterally spaced from the wellpair without any other well therebetween;

(b) applying cyclic steam stimulation to one of the wells of the well pair and to the single well; and then (c) producing oil from a lower one of the wells of the well pair and from the single well by applying steam assisted gravity drainage to the well pair.

14. A method as claimed in claim 13 wherein the cyclic steam stimulation is applied for one, two or three cycles.

* * * * *